US010900145B2

(12) United States Patent
Kim et al.

(10) Patent No.: US 10,900,145 B2
(45) Date of Patent: Jan. 26, 2021

(54) NANOFIBER YARN SPINNING SYSTEM

(71) Applicant: Lintec of America, Inc., Richardson, TX (US)

(72) Inventors: BaeKyun Kim, Frisco, TX (US); Julia Bykova, Richardson, TX (US); Luis Plata, Allen, TX (US); Yang Yang, Dallas, TX (US); Marcio D. Lima, Richardson, TX (US)

(73) Assignee: LINTEC OF AMERICA, INC., Richardson, TX (US)

( * ) Notice: Subject to any disclaimer, the term of this patent is extended or adjusted under 35 U.S.C. 154(b) by 65 days.

(21) Appl. No.: 15/844,756

(22) Filed: Dec. 18, 2017

(65) Prior Publication Data

US 2018/0171512 A1 Jun. 21, 2018

Related U.S. Application Data

(60) Provisional application No. 62/435,878, filed on Dec. 19, 2016, provisional application No. 62/506,056, filed on May 15, 2017.

(51) Int. Cl.
*D02G 1/02* (2006.01)
*D01H 1/02* (2006.01)

(52) U.S. Cl.
CPC ..... *D02G 1/022* (2013.01); *D01H 1/02* (2013.01)

(58) Field of Classification Search
CPC ..... D02G 1/022; D01H 1/02; D01H 1/115
USPC ..... 57/334, 335, 336, 337, 341
See application file for complete search history.

(56) References Cited

U.S. PATENT DOCUMENTS 3,668,855 A * 6/1972 Leeson ..... D02G 1/08 57/290
3,724,196 A * 4/1973 Holland ..... D02G 1/08 57/284
3,726,073 A * 4/1973 Stutz ..... D02G 1/0226 57/290

(Continued)

FOREIGN PATENT DOCUMENTS

FR 1158478 A * 6/1958 ..... D02G 1/0206
JP 2017019690 1/2017
TW 200825222 A 6/2008

OTHER PUBLICATIONS

Bhowmick, Anil K., et al. "Surface Properties of EPDM, Silicone Rubber, and Their Blend during Aging." Journal of Applied Polymer Science, John Wiley & Sons, Ltd, Mar. 10, 2003, onlinelibrary.wiley.com/doi/abs/10.1002/app.1995.070570513. (Year: 1995).*

(Continued)

*Primary Examiner* — Khoa D Huynh
*Assistant Examiner* — Grace Huang
(74) *Attorney, Agent, or Firm* — Greenblum & Bernstein, P.L.C.

(57) ABSTRACT

Methods, systems, and apparatus for fabricating nanofiber yarn at rates of at least 30 m/min (1.8 kilometers (km)/hour (hr)) using a "false twist" nanofiber yarn spinner and a false twist spinning technique are disclosed. In a false twist spinning technique, a twist is introduced to nanofibers in a strand by twisting the nanofibers at points between ends of the strand. This is in contrast to the "true twist" technique where one end of a strand is fixed and the opposing end of the strand is rotated to introduce the twist to intervening portions of yarn.

10 Claims, 9 Drawing Sheets

(56) References Cited

U.S. PATENT DOCUMENTS 3,745,755 A * 7/1973 Keto ..... D02G 1/08 57/342
3,802,175 A * 4/1974 Doschko ..... D02G 1/08 57/284
3,875,734 A * 4/1975 Dupeuble ..... D02G 1/08 57/342
3,903,683 A * 9/1975 Shino ..... D01H 4/08 57/417
4,002,017 A * 1/1977 Weinz ..... D02G 1/082 57/341
4,024,698 A * 5/1977 Weiss ..... B65H 51/16 57/305
4,120,139 A * 10/1978 Terasawa ..... D07B 3/00 226/189
4,399,649 A * 8/1983 Gallina ..... D01H 7/46 57/115
4,776,162 A * 10/1988 Glaser ..... D02G 1/00 28/271
5,407,620 A * 4/1995 Burchette ..... D01D 5/22 264/103
5,749,215 A * 5/1998 Harrison, Jr. ..... D02G 1/082 29/894.32
6,477,828 B1 * 11/2002 Nolle ..... D02G 1/024 57/332
7,078,096 B2 * 7/2006 Konishi ..... D01F 6/62 428/357
8,101,688 B2 * 1/2012 Kimura ..... D01F 6/625 428/357
8,444,947 B2 * 5/2013 Feng ..... B82Y 30/00 423/447.1
8,549,830 B1 * 10/2013 Tao ..... D01H 7/92 57/336
8,926,933 B2 * 1/2015 Zhang ..... B82Y 10/00 423/447.3
2008/0170982 A1 7/2008 Zhang et al.
2011/0131944 A1 * 6/2011 Nishiwaki ..... D02G 1/04 57/336
2015/0152852 A1 6/2015 Li et al.
2016/0138202 A1 * 5/2016 Takashima ..... D02G 3/16 57/328
2016/0160398 A1 6/2016 Yano et al.
2016/0160401 A1 * 6/2016 Takashima ..... D01H 1/115 57/333
2018/0073166 A1 * 3/2018 Morihara ..... D02G 3/16
2018/0179064 A1 * 6/2018 Inoue ..... D04H 1/4242
2019/0072440 A1 * 3/2019 Menon ..... D02G 3/32

OTHER PUBLICATIONS

"False Twist Texturing Principle", http://www.polyspintex.com/educational/false-twist-texturing-principle, 2017, PolySpinTex, Inc., Charlotte, NC, retrieved on Apr. 13, 2018.

Mandal, Jasimuddin, "Yarn Twist | Relationship Between Yarn Count and Twist | Principles of Twist Measuring Methods", Textile Learner, http://textilelearner.blogspot.com/2013/03/yarn-twist-relationship-between-yarn.html,retrieved on Apr. 13, 2018.

International Search Report and Written Opinion received for Patent Application No. PCT/US2017/066665, dated Mar. 13, 2018, 10 pages.

Notice of Allowance and Search Report received for TW Application No. 106144401, dated Feb. 27, 2019. 4 pages.

International Preliminary Report on Patentability received for PCT Application No. PCT/US2017/066665. dated Jun. 25, 2019. 5 pages.

* cited by examiner

Top View

Side View

Plan View

NANOFIBER YARN SPINNING SYSTEM

TECHNICAL FIELD

The present disclosure relates generally to yarn fabrication. Specifically, the present disclosure relates to a nanofiber yarn spinning system.

BACKGROUND

Short fibers of materials (often referred to as "staples") of cotton, polyester, flax, wool, among others, are transformed into more technologically useful forms by spinning the fibers into yarn or thread. The yarn or thread, which is usually much longer than the individual fibers, can then be processed into a fabric. The fabric can be used for any number of textile applications (e.g., clothing, bedding, furnishings).

There are several different methods by which individual fibers are spun into yarn or thread. Generally, the spinning of yarn occurs by fixing both ends of the fibers and then twisting one end of the fibers relative to the opposing end about a longitudinal axis with which the fibers are aligned to produce a helical structure of fibers. This process is often referred to as a "true twist" process of yarn spinning. Twisted yarn, having a "twist angle" θ, is schematically illustrated in FIG. 1A. A schematic representation fibers being spun into a true twist yarn appears in FIG. 1B.

This twisting process causes the short fibers to be bound to one another, thus forming a continuous strand of yarn that is much longer than the individual short fibers. The number of twists (i.e., the revolutions of a fiber about the longitudinal axis of a thread) per unit length of thread is often used to characterize a thread. This is because the number of twists and the type of fiber used for the thread provide an indication of various properties of the thread. For example, fewer twists per unit length of a woolen yarn preserves inter-fiber spaces within the yarn thus improving the thermal insulating properties of the yarn and providing a coarser surface texture to fabrics made from the yarn. More twists per unit length of a woolen yarn produces a "worsted" thread with a much smoother texture.

SUMMARY

One example of the present disclosure includes a method for spinning nanofiber yarn including: providing a nanofiber forest on a substrate; drawing the nanofiber forest from the substrate at an angle α to form a nanofiber sheet; infiltrating the nanofiber sheet with a fluid to form an untwisted nanofiber strand having an exterior surface and a longitudinal axis; and applying a force to the exterior surface of the untwisted nanofiber strand between endpoints of the untwisted nanofiber strand, the applied force having a component perpendicular to the longitudinal axis, thus forming a false twist nanofiber yarn. In one embodiment, wherein applying the force comprises contact between the untwisted nanofiber strand and the twisting surface. In one embodiment, wherein the contact between the untwisted nanofiber strand and the twisting surface occurs during less than 5 milliseconds. In one embodiment, wherein the contact between the untwisted nanofiber strand and the twisting surface occurs during less than 0.5 milliseconds. In one embodiment, wherein applying the force comprises using a silicone rubber surface. In one embodiment, wherein applying the force comprises using a surface with a coefficient of friction of from 0.25 to 0.75 between the twisting surface and at least one of the untwisted nanofiber strand and the nanofiber yarn. In one embodiment, wherein applying the force comprises using a surface with a surface energy of less than 30 milliNewtons/meter. In one embodiment, further comprising infiltrating the nanofiber sheet with at least one of a polymer and a nanoparticle. In one embodiment, further comprising drying the untwisted nanofiber strand to remove the fluid. In one embodiment, wherein the angle α is in a range from 2° to 20°.

An example of the present disclosure includes a nanofiber spinning system including: a yarn spinner including a rotational twist ring having an inner surface with a radius of curvature less than 1 centimeter; and a nanofiber forest disposed on a substrate, the nanofiber forest drawn from the substrate at an angle α to form a nanofiber strand at the densification station. An embodiment, further includes a drier disposed between the densification station and the yarn spinner. An embodiment of the yarn spinner further includes a frame; a circular bearing mounted to the frame, the circular bearing having an outer diameter proximate to the frame and an inner diameter opposite the outer diameter; and a twist ring having an inner surface and an outer surface, the outer surface mounted to the inner diameter of the circular bearing and the inner surface exposed. In an embodiment, a densification station that includes a container and an organic solvent disposed within the container. In an embodiment, wherein the solvent further comprises an organic solvent. In an embodiment, wherein the organic solvent comprises at least one of a solvated polymer and a suspended particle. An embodiment of the example, wherein the angle α is in a range from 2° to 20°. An embodiment of the example further including a bobbin for winding nanofiber yarn exiting yarn spinner, the bobbin applying tension to the nanofiber yarn. In an embodiment, the yarn spinner further includes a first wheel and a second wheel spaced apart from each other, both of the first wheel and the second wheel configured for rotation; a twisting belt disposed around both of the first wheel and the second wheel, the twisting belt rotated by the rotation of the first wheel and the second wheel; and a plurality of posts proximate to the twisting belt. In an embodiment, wherein the twist ring has a silicone rubber surface. wherein the inner surface of the twist ring has a coefficient of friction of from 0.25 to 0.75 between the twist ring and the nanofiber strand. In an embodiment, wherein the twist ring has a surface energy of less than 30 milliNewtons/meter. In an embodiment, wherein an inner diameter of the twist ring corresponding to the inner surface of the twist ring is 100 mm.

The figures depict various embodiments of the present disclosure for purposes of illustration only. Numerous variations, configurations, and other embodiments will be apparent from the following detailed discussion.

DETAILED DESCRIPTION

Overview

Figure 1A:
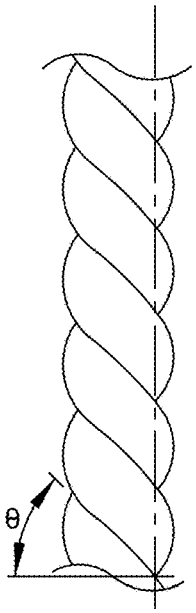
FIG. 1A (PRIOR ART)
FIG. 1A is a depiction of a true-twisted yarn as described in the prior art.
Figure 1B:
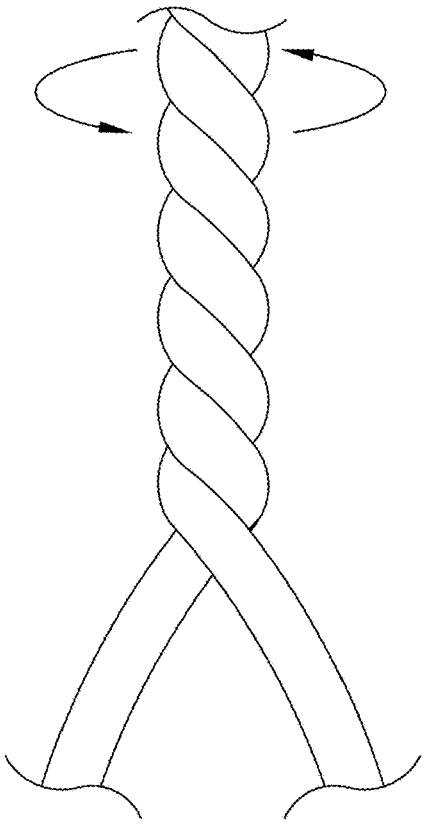
FIG. 1B (PRIOR ART)
FIG. 1B is schematic depiction of true twist yarn spun according to techniques of the prior art.

Spinning individual nanofibers into nanofiber yarn using a "true twist" process, which fixes both ends of the individual nanofibers and twists one of the fixed ends relative to the other end to produce a helical structure (as shown in FIG. 1B), poses technological challenges. When the nanofibers are drawn from a nanofiber "forest," as is described below in the context of FIGS. 2-5, extremely high revolution speeds are needed to produce manufacturable quantities of yarn from the nanofibers, as illustrated by the following example. Given a common range of nanofiber density in a nanofiber forest (on the order of a billion nanofibers per square centimeter (cm)), a yarn having a 30 μm diameter could be produced at 1 meter (m)/minute (min) by twisting one end of the nanofibers at a rate of 25,000 RPM in a true twist process. Even at this high rate of rotation (25,000 RPM), producing yarn at 1 m/min is too slow for economically viable production.

Figure 1C:
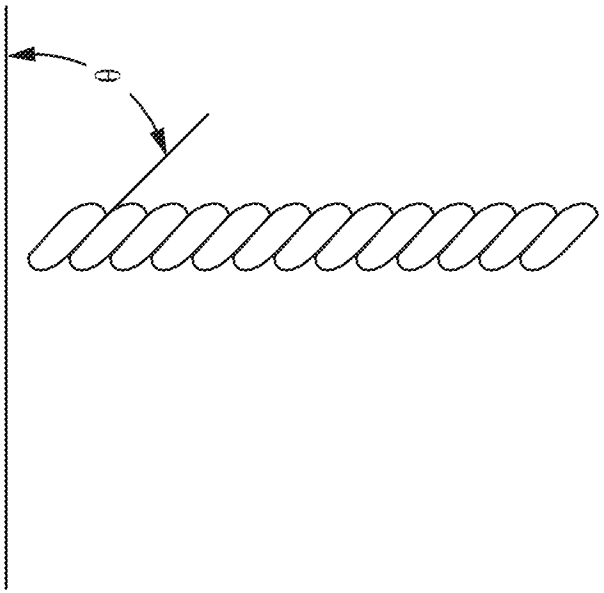
FIG. 1C is an illustration of a twisted yarn having a smaller yarn diameter than the yarn illustrated in FIG. 1A.

Furthermore, even at a rate 25,000 RPM of a true twist spinner, the yarn production rate of 1 m/min is too slow for yarn production to be "balanced" with nanofiber forest production. In some examples approximately 1 centimeter (cm) of nanofiber forest can be used to produce approximately 5 meters of yarn. This illustrates the imbalance in the different stages of nanofiber yarn processing: nanofiber forest can be produced at a higher rate per unit time than can be produced into yarn using a true twist yarn spinning process. This is a barrier to designing a continuous process in which nanofiber forests are produced at a rate that approximates that of a rate of nanofiber yarn production. This is particularly true for nanofiber yarns having micron-sized (or smaller) diameters because generally the number of revolutions in a yarn (and therefore the number of revolutions of a true twist spinning apparatus) used to produce a given twist angle in a yarn increases as the diameter of the yarn decreases. This is schematically illustrated in FIG. 1C, which shows a smaller diameter yarn than the one illustrated in FIG. 1A. While the yarns in FIG. 1A and FIG. 1C having a same twist angle Θ, the smaller diameter yarn illustrated in FIG. 1C includes a greater number of twists per unit length than the larger diameter yarn shown in FIG. 1A. As the number of revolutions per unit length of yarn increases, the rate of yarn production for a given rotation rate of a spinner decreases.

Embodiments of the present disclosure include methods, systems, and apparatuses for fabricating nanofiber yarn at rates of at least 30 m/min (1.8 kilometers (km)/hour (hr)) using a "false twist" yarn spinner and a false twist spinning technique. In a false twist spinning technique, a twist is introduced using an untwisted nanofiber strand by twisting the nanofiber strand at points between ends of the strand (i.e., in the "middle" of an untwisted strand), and one end of the yarn need not be rotated with reference to the second end of the yarn. This is in contrast to the "true twist" technique shown in FIG. 1B where one end of a strand is fixed ("stationary") and the opposing end of the strand is rotated relative to the opposing fixed end to introduce the twist to intervening portions of yarn.

Benefits of the "false twist" method include not only greater production rates, but also lower rotational speeds used for introducing the twist to the nanofiber strand. These lower rotational speeds (e.g., 50 RPM to 100 RPM, 100 RPM to 1000 RPM, 1000 RPM to 10,000 RPM) lower the cost of the twisting apparatus compared to equipment operating at high speeds (e.g., 10,000 RPM, 15,000 RPM, 25,000 RPM or higher). Lower rotational speeds in turn reduce the frequency of equipment breakdown and maintenance, which in turn reduces costs of producing the nanofiber yarn. Potential damage to the yarn itself is also reduced. Furthermore, unlike conventional fibers (e.g., cotton, wool, flax, polyester), nanofibers twisted into yarn using "false twisting" are not prone to unraveling because, it is believed, Van der Waals forces between the individual nanofibers improve inter-fiber cohesion within the yarn. Rotational speeds of the twist ring may also be measured based on the number of spins applied to the yarn in a given amount of time or in a specific length of yarn. For example, the twist ring may be rotated at a speed of 1000 yarn circumferences per second or 1000 yarn circumferences per cm of yarn. Various embodiments may use rotational speeds of greater than 100, $10^3$, $10^4$ or $10^5$ yarn circumferences per second or less than 100, $10^3$, $10^4$ or $10^5$ yarn circumferences per second. Other embodiments may apply rotational speeds of greater than 100, $10^3$, $10^4$, $10^5$, $10^6$ or $10^7$ yarn circumferences per cm of yarn or less than 100, $10^3$, $10^4$, $10^5$, $10^6$, $10^7$, $10^8$ yarn circumferences per cm of yarn.

Another benefit of the false twist method is that the rate of production of nanofiber yarn is more closely aligned with the rate of production of nanofiber forest. This balancing of product rates facilitates design of a continuous process by reducing the need for batch processing and accumulation of work-in-process at internal inventory points. Continuous processes are generally considered to be more economical and have fewer quality defects than batch processes, thus reducing the cost of producing nanofiber yarn. Yet another advantage of embodiments of the present disclosure is that the continuous processing of a nanofiber forest into a strand of untwisted nanofiber (referred to herein as a "nanofiber strand" or "untwisted nanofiber strand") and further continuous processing of the nanofiber strand into "false twisted" nanofiber yarn can facilitate production of a nanofiber yarn that has a uniform consistency, morphology, and exhibits consistent mechanical, electrical, and physical properties.

Before describing the false twist process and apparatus for fabricating nanofiber yarn, FIGS. 2-5 and their corresponding description explain examples of nanofibers, nanofiber forests, and corresponding fabrication techniques Properties of Carbon Nanofibers and Carbon Nanofiber Sheets As used herein, the term "nanofiber" means a fiber having a diameter less than 1 μm. While the embodiments herein are primarily described as being fabricated from carbon nanotubes, it will be appreciated that other carbon allotropes, whether graphene, micron or nano-scale graphite fibers and/or plates, and even other compositions of nano-scale fibers such as boron nitride may be used to fabricate nanofiber sheets using the techniques described below. As used herein, the terms "nanofiber" and "carbon nanotube" encompass both single walled carbon nanotubes, double walled carbon nanotubes, triple walled carbon nanotubes and/or multi-walled carbon nanotubes in which carbon atoms are linked together to form a cylindrical structure. In some embodiments, carbon nanotubes as referenced herein have between 4 and 10 walls. As used herein, a "nanofiber sheet" or simply "sheet" refers to a sheet of nanofibers aligned via a drawing process (as described in PCT Publication No. WO 2007/015710, and incorporated by reference herein in its entirety) so that a longitudinal axis of a nanofiber of the sheet is parallel to a major surface of the sheet, rather than perpendicular to the major surface of the sheet (i.e., in the as-deposited form of the sheet, often referred to as a "forest").

The dimensions of carbon nanotubes can vary greatly depending on production methods used. For example, the diameter of a carbon nanotube may be from 0.4 nm to 100 nm and its length may range from 10 μm to greater than 55.5 cm. Carbon nanotubes are also capable of having very high aspect ratios (ratio of length to diameter) with some as high as 132,000,000:1 or more. Given the wide range of dimensional possibilities, the properties of carbon nanotubes are highly adjustable, or tunable. While many intriguing properties of carbon nanotubes have been identified, harnessing the properties of carbon nanotubes in practical applications requires scalable and controllable production methods that allow the features of the carbon nanotubes to be maintained or enhanced.

Due to their unique structure, carbon nanotubes possess particular mechanical, electrical, chemical, thermal and optical properties that make them well-suited for certain applications. In particular, carbon nanotubes exhibit superior electrical conductivity, high mechanical strength, good thermal stability and are also hydrophobic. In addition to these properties, carbon nanotubes may also exhibit useful optical properties. For example, carbon nanotubes may be used in light-emitting diodes (LEDs) and photo-detectors to emit or detect light at narrowly selected wavelengths. Carbon nanotubes may also prove useful for photon transport and/or phonon transport.

Nanofiber Forest

Figure 2:
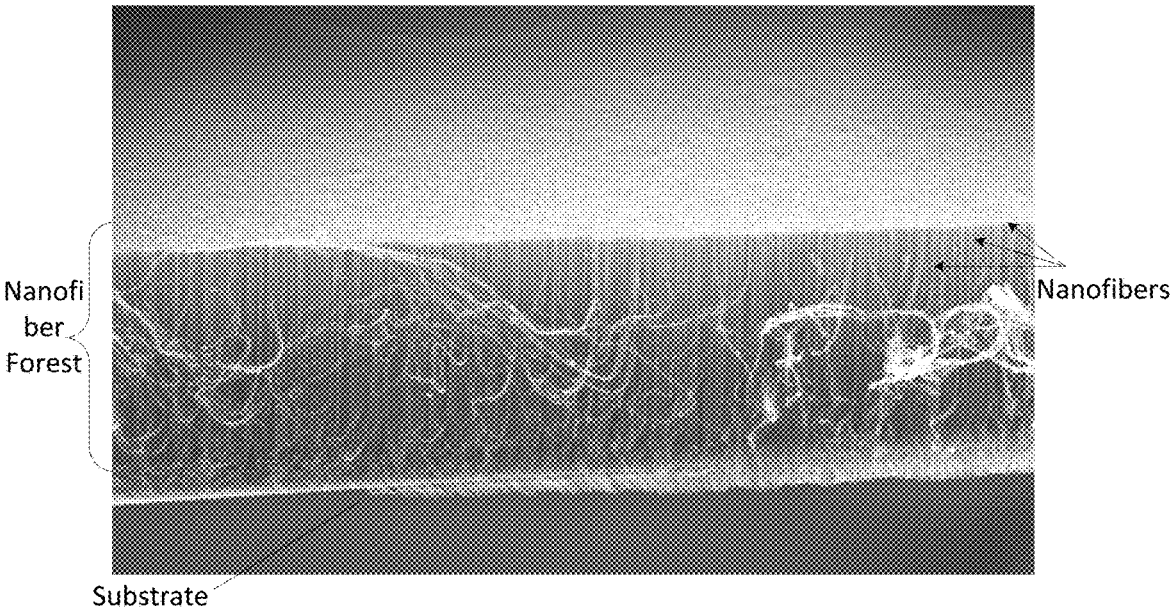
FIG. 2 illustrates an example forest of nanofibers on a substrate, in an embodiment.

In accordance with various embodiments of the subject disclosure, nanofibers (including but not limited to carbon nanotubes) can be arranged in various configurations, including in a configuration referred to herein as a "forest." As used herein, a "forest" of nanofibers or carbon nanotubes refers to an array of nanofibers having approximately equivalent dimensions that are arranged substantially parallel to one another on a substrate. FIG. 2 shows an example forest of nanofibers on a substrate. The substrate may be any shape but in some embodiments the substrate has a planar surface on which the forest is assembled. As can be seen in FIG. 2, the nanofibers in the forest may be approximately equal in height and/or diameter.

Nanofiber forests as disclosed herein may be relatively dense. Specifically, the disclosed nanofiber forests may have a density of at least 1 billion nanofibers/$cm^2$. In some specific embodiments, a nanofiber forest as described herein may have a density of between 10 billion/$cm^2$ and 30 billion/$cm^2$. In other examples, the nanofiber forest as described herein may have a density in the range of 90 billion nanofibers/$cm^2$. The forest may include areas of high density or low density and specific areas may be void of nanofibers. The nanofibers within a forest may also exhibit inter-fiber connectivity. For example, neighboring nanofibers within a nanofiber forest may be attracted to one another by van der Waals forces.

Example Methods for Producing Nanofiber Forests

Various methods can be used to produce nanofiber forests in accordance with the present disclosure. For example, in some embodiments nanofibers may be grown in a high-temperature furnace. In some embodiments, catalyst may be deposited on a substrate, placed in a reactor and then may be exposed to a fuel compound that is supplied to the reactor. Substrates can withstand temperatures of greater than 800° C. to 1000° C. and may be inert materials. The substrate may comprise stainless steel or aluminum disposed on an underlying silicon (Si) wafer, although other ceramic substrates may be used in place of the Si wafer (e.g., alumina, zirconia, SiO2, glass ceramics). In examples where the nanofibers of the forest are carbon nanotubes, carbon-based compounds, such as acetylene may be used as fuel compounds. After being introduced to the reactor, the fuel compound(s) may then begin to accumulate on the catalyst and may assemble by growing upward from the substrate to form a forest of nanofibers.

Figure 3:
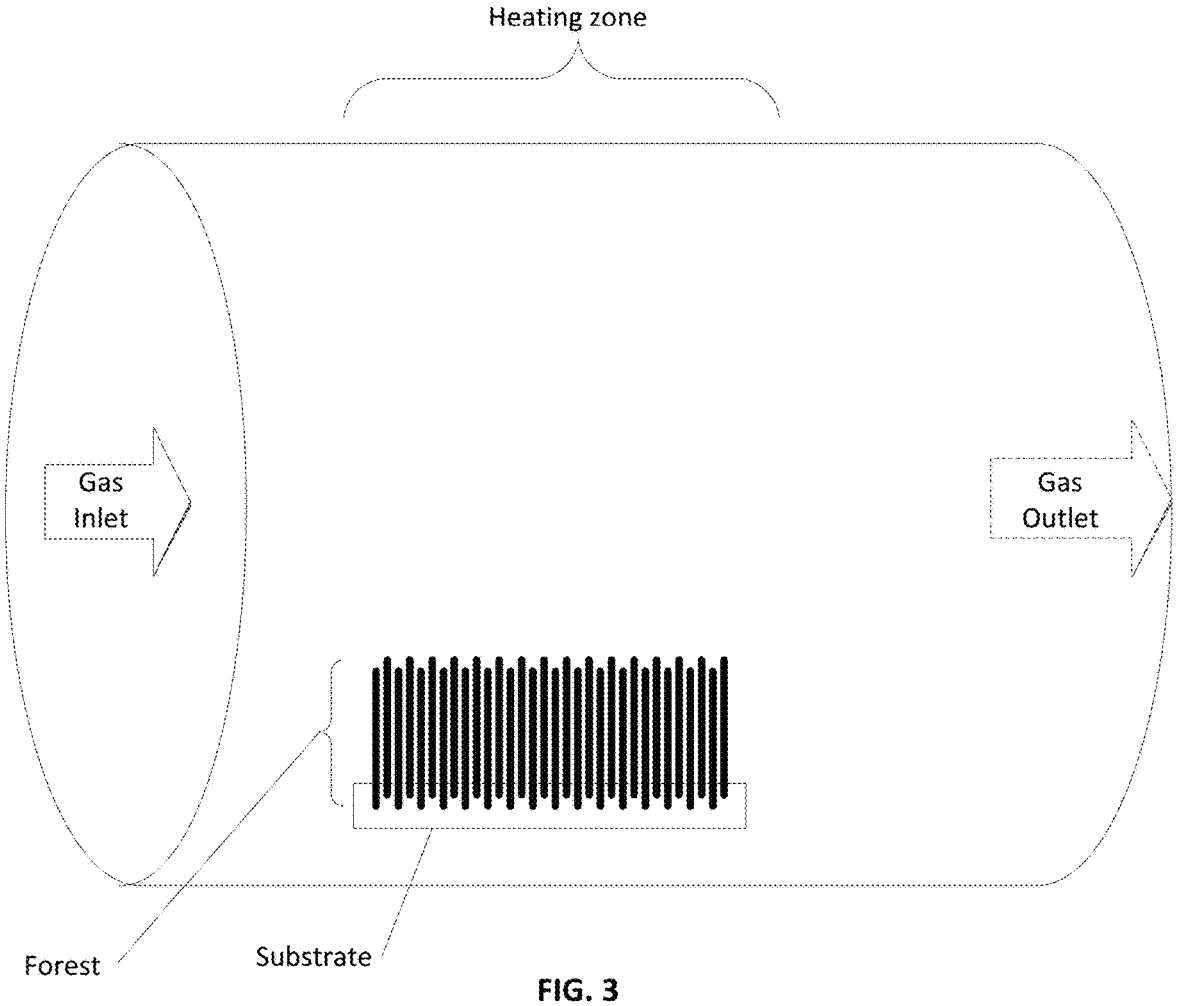
FIG. 3 is a schematic diagram of a reactor for growing nanofibers, in an embodiment.

A diagram of an example reactor for nanofiber growth is shown in FIG. 3. As can be seen in FIG. 3, the reactor may include a heating zone where a substrate can be positioned to facilitate nanofiber forest growth. The reactor also may include a gas inlet where fuel compound(s) and carrier gases may be supplied to the reactor and a gas outlet where expended fuel compounds and carrier gases may be released from the reactor. Examples of carrier gases include hydrogen, argon, and helium. These gases, in particular hydrogen, may also be introduced to the reactor to facilitate growth of the nanofiber forest. Additionally, dopants to be incorporated in the nanofibers may be added to the gas stream. Example methods of adding dopants during deposition of the nanofiber forest are described at paragraph 287 of PCT Publication No. WO 2007/015710 and are incorporated by reference herein. Other example methods of doping or providing an additive to the forest include surface coating, dopant injection, or other deposition and/or in situ reactions (e.g., plasma-induced reactions, gas phase reaction, sputtering, chemical vapor deposition). Example additives include polymers (e.g., poly(vinyl alcohol), poly(phenylene terapthalamide) type resins, poly(p-phenylene benzobisoxazole), polyacrylonitrile, poly(styrene), poly(ether etherketone) and poly(vinyl pyrrodidone, or derivations and combinations thereof), gases of elements or compounds (e.g., fluorine), diamond, palladium and palladium alloys, among others.

The reaction conditions during nanofiber growth can be altered to adjust the properties of the resulting nanofiber forest. For example, particle size of the catalyst, reaction temperature, gas flow rate and/or the reaction time can be adjusted as needed to produce a nanofiber forest having the desired specifications. In some embodiments, the position of catalyst on the substrate is controlled to form a nanofiber forest having a desired pattern. For example, in some embodiments catalyst is deposited on the substrate in a pattern and the resulting forest grown from the patterned catalyst is similarly patterned. Exemplary catalysts include iron with a, buffer layer of silicon oxide ($SiO_2$) or aluminum oxide ($Al_2O_3$). These may be deposited on the substrate using chemical vapor deposition (CVD), pressure assisted chemical vapor deposition (PCVD), electron beam (eBeam) deposition, sputtering, atomic layer deposition (ALD), laser assisted CVD, plasma enhanced CVD, thermal evaporation, various electrochemical methods, among others.

After formation, the nanofiber forest may optionally be modified. For example, in some embodiments, the nanofiber forest may be exposed to a treatment agent such as an oxidizing or reducing agent. In some embodiments, the nanofibers of the forest may optionally be chemically functionalized by a treatment agent. Treatment agent may be introduced to the nanofiber forest by any suitable method, including but not limited to chemical vapor deposition (CVD) or any of the other techniques and additives/dopants presented above. In some embodiments, the nanofiber forest may be modified to form a patterned forest. Patterning of the forest may be accomplished, for example, by selectively removing nanofibers from the forest. Removal can be achieved through chemical or physical means.

Nanofiber Sheet

In addition to arrangement in a forest configuration, the nanofibers of the subject application may also be arranged in a sheet configuration. As used herein, the term "nanofiber sheet," "nanotube sheet," or simply "sheet" refers to an arrangement of nanofibers where the nanofibers are aligned end to end in a plane. In some embodiments, the sheet has a length and/or width that is more than 100 times greater than the thickness of the sheet. In some embodiments, the length, width or both, are more than $10^3$, $10^6$ or $10^9$ times greater than the average thickness of the sheet. A nanofiber sheet can have a thickness of, for example, between approximately 5 nm and 30 μm and any length and width that are suitable for the intended application. In some embodiments, a nanofiber sheet may have a length of between 1 cm and 10 meters and a width between 1 cm and 1 meter. These lengths are provided merely for illustration. The length and width of a nanofiber sheet are constrained by the configuration of the manufacturing equipment and not by the physical or chemical properties of any of the nanotubes, forest, or nanofiber sheet. For example, continuous processes can produce sheets of any length. These sheets can be wound onto a roll as they are produced.

Figure 4:
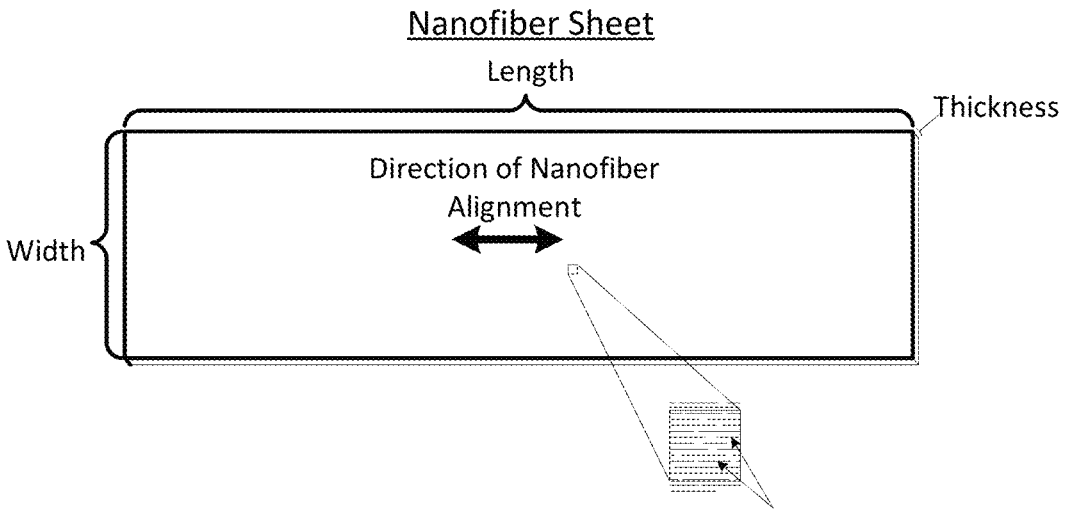
FIG. 4 is an illustration of a nanofiber sheet that identifies relative dimensions of the sheet and schematically illustrates nanofibers within the sheet aligned end-to-end in a plane parallel to a surface of the sheet, in an embodiment.

An illustration of an example nanofiber sheet is shown in FIG. 4 with relative dimensions denoted. As can be seen in FIG. 4, the axis in which the nanofibers are aligned end-to end is referred to as the direction of nanofiber alignment. In some embodiments, the direction of nanofiber alignment may be continuous throughout an entire nanofiber sheet. Nanofibers are not necessarily perfectly parallel to each other and it is understood that the direction of nanofiber alignment is an average or general measure of the direction of alignment of the nanofibers.

Nanofiber sheets may be assembled using any type of suitable process capable of producing the sheet. In some example embodiments, nanofiber sheets may be drawn from a nanofiber forest. An example of a nanofiber sheet being drawn from a nanofiber forest is shown in FIG. 5.

Figure 5:
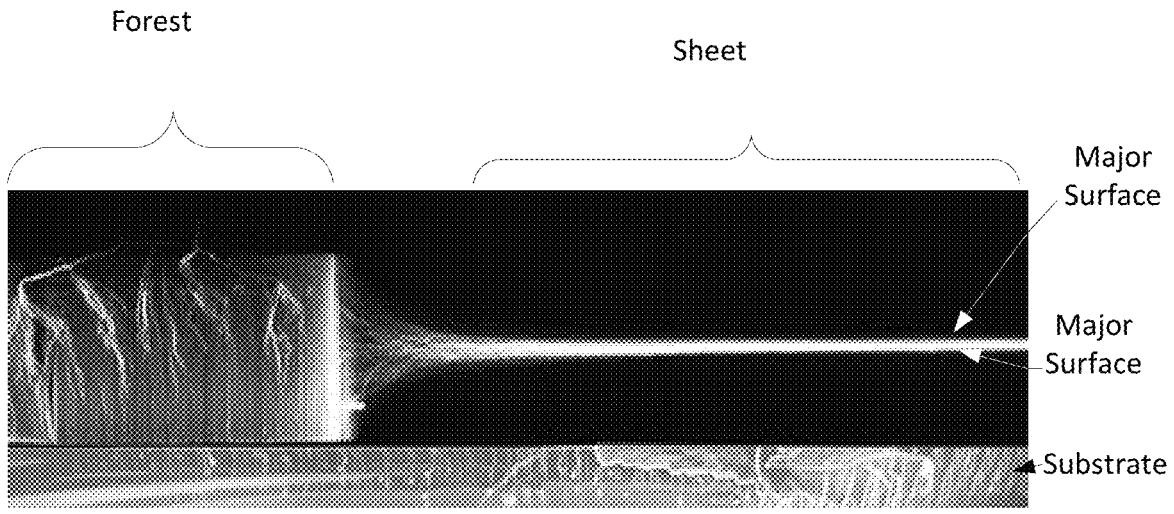
FIG. 5 is an image of a nanofiber sheet being laterally drawn from a nanofiber forest, the nanofibers aligning from end-to-end as schematically shown in FIG. 4, in an embodiment.

As can be seen in FIG. 5, the nanofibers may be drawn laterally from the forest and then align end-to-end to form a nanofiber sheet. In embodiments where a nanofiber sheet is drawn from a nanofiber forest, the dimensions of the forest may be controlled to form a nanofiber sheet having particular dimensions. For example, the width of the nanofiber sheet may be approximately equal to the width of the nanofiber forest from which the sheet was drawn. Additionally, the length of the sheet can be controlled, for example, by concluding the draw process when the desired sheet length has been achieved.

Nanofiber Yarn Fabrication System

Figure 6A:
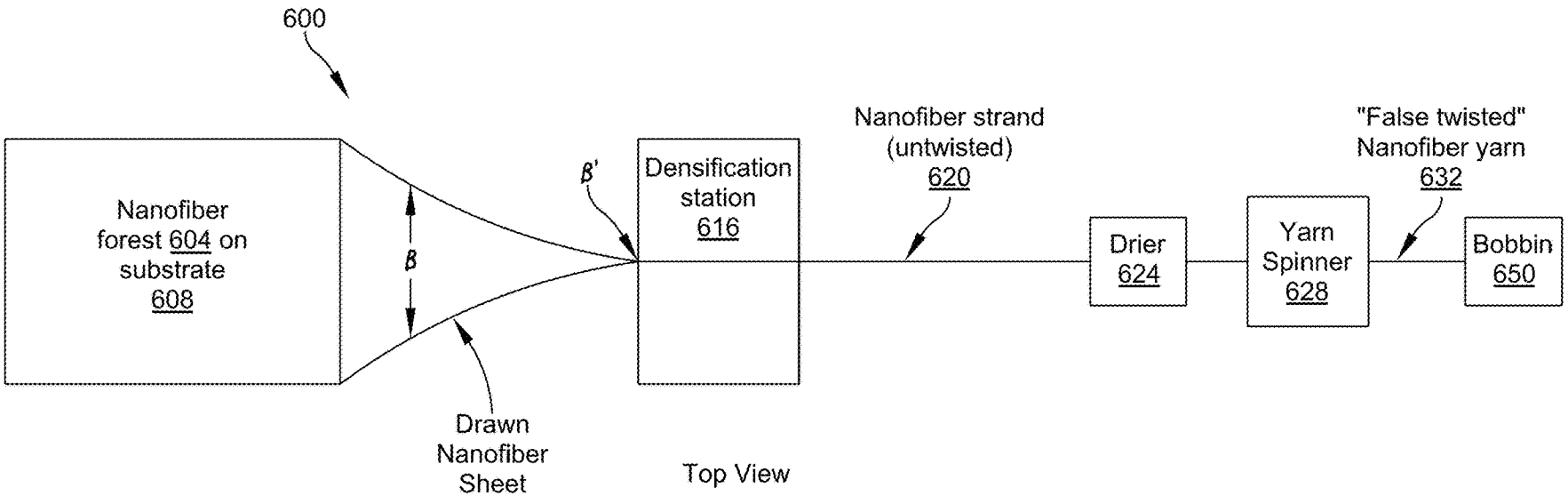
FIG. 6A is a schematic plan view depiction of a false twist spinning process for nanofiber yarns, in an embodiment.
Figure 6B:
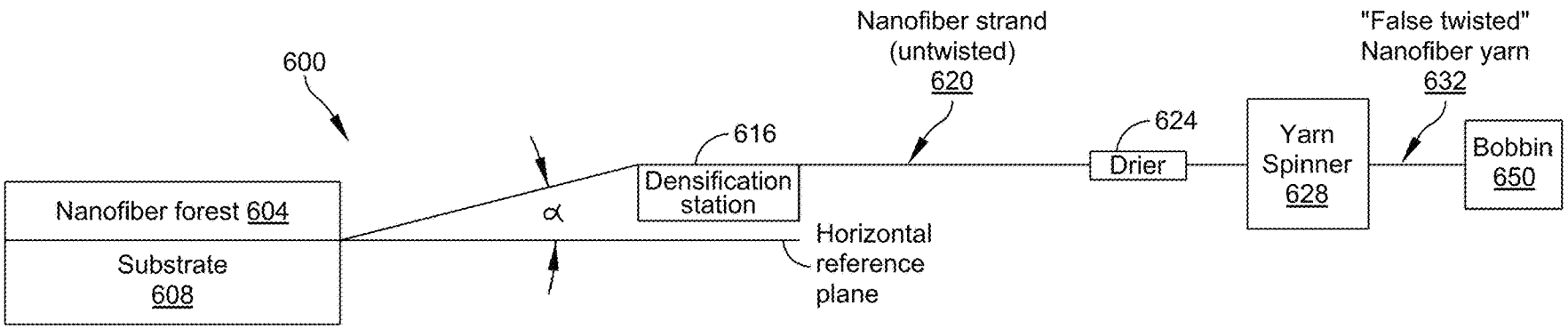
FIG. 6B is a schematic plan view depiction of a false twist spinning process for nanofiber yarns, in an embodiment.

FIGS. 6A and 6B illustrate a top view and a side view, respectively, of an example nanofiber yarn fabrication system 600 for drawing a nanofiber forest into a strand of nanofiber yarn. The fabrication system 600 depicted in FIGS. 6A and 6B includes a nanofiber forest 604 on a substrate 608, a densification station 616, an optional drier 624, a yarn spinner 628, and a bobbin 650.

The nanofiber forest 604 is fabricated using, for example, the methods described above in the context of FIGS. 2 and 3 and is disposed on a substrate 608, which is used to grow the nanofiber forest 604, also described above. The nanofiber forest 604 is then drawn from the substrate 608 into a nanofiber sheet 612. The drawn nanofiber sheet 612 as it is depicted in FIG. 6A illustrates a physical transition between the planar configuration of the nanofiber forest 604 on the substrate 608 to a progressively narrower configuration. That is, as the nanofiber sheet 612 is drawn from the nanofiber forest 604, at an angle α with respect to a reference plane containing a surface of the substrate 608 in contact with the nanofiber forest 604, as shown in FIG. 6B, a width β of the nanofiber forest is reduced from a width approximately that of the substrate 608 to a width β' closer to that of a final nanofiber yarn. Approximately at the width β' the nanofiber sheet is referred to as an untwisted nanofiber strand, although this is for convenience of explanation only.

Examples of the angle α can include any of the following: 0° to 1°; 2° to 20°; 1° to 5°; 5° to 10°; 10° to 20°; 5° to 15°; 15° to 20°.

Examples of the width β can be any value selected for a width of the substrate 608. Example widths β, provided only for illustration, can be within any of the following ranges: 0.5 cm to 50 cm; 1 cm to 40 cm; 2 cm to 30 cm; 3 cm to 20 cm; 4 cm to 15 cm; 5 cm to 10 cm; 2 cm to 40 cm; 2 cm to 30 cm; 2 cm to 20 cm; 2 cm to 10 cm; 3 cm to 40 cm; 3 cm to 30 cm; 3 cm to 20 cm; 3 cm to 10 cm; 4 cm to 40 cm; 4 cm to 30 cm; 4 cm to 20 cm, 4 cm to 10 cm; 20 cm to 40 cm; 20 cm to 30 cm; 30 cm to 50 cm, and 10 cm to 20 cm. Examples of the width β', provided only for illustration, can be within any of the following ranges: 1 μm to 1 cm; 1 μm to 1 mm; 1 μm to 100 μm; 1 μm to 50 μm; 1 μm to 30 μm; 5 μm to 50 μm; 10 μm to 50 μm.

To encourage intimate contact and longitudinal alignment between the individual nanofibers (as illustrated in FIG. 4) as they are drawn together into an untwisted nanofiber strand, the nanofiber sheet 612 at the width β' is passed through a densification station 616.

In one example, the densification station 616 includes a mechanical apparatus used to urge individual nanofibers together. Embodiments of the mechanical apparatus can include rollers that impinge on the nanofibers to mechanically "densify" the nanofibers so as to reduce the dimensions of the spaces between the nanofibers. Other mechanical apparatus include pressurized gas, a mechanical press, or a vacuum, any combination of which can be applied to reduce inter-fiber spacing.

In one example, the densification station 616 is used to apply a densifying fluid, which includes, but is not limited to polymers, polymer solutions, adhesive solutions and organic solvents such as alcohols, polyalcohols, aldehydes, ethers, aliphatic hydrocarbons and aromatic hydrocarbons, among others, to the untwisted nanofiber strand 620 having the width β'. This exposure causes the nanofibers within the untwisted nanofiber strand 620 to be drawn together, "densifying" the nanofiber sheet further. In one example the densification station 616 includes a fluid reservoir and a dispenser, such as mass flow controller connected to a nozzle, that controls the deposition of the fluid in the reservoir onto the nanofiber sheet 612. The rate of deposition of the fluid can be selected based on any number of factors including the chemical composition, viscosity, and surface tension of the fluid being deposited, a rate (mass/time or volume/time or mass/length) at which the nanofiber sheet 612 is passed through the densification station 616, and a density (molecules/unit volume of fluid or particles/unit volume of fluid) of a second material suspended or dissolved in the fluid. In another example, the densification station is a static bath disposed in a container that the untwisted nanofiber strand 620 is passed through or contacted with. The chemical composition and the physical properties (e.g., viscosity, conductivity, density) of the fluid in the bath can be monitored and maintained at constant levels to facilitate a consistent nanofiber yarn composition.

In some embodiments, additional materials can be introduced into the nanofiber sheet 612 and/or nanofiber strand 620 by suspending or dissolving one more additional materials in the fluid of the densification station 616. The additional material(s) are then carried into (also known as "infiltrating") the nanofibers and/or the gaps between nanofibers by the fluid provided at the densification station. Examples of additional materials include conductive nanoparticles and nanowires (silver (Ag), copper (Cu), gold (Au), combinations thereof), magnetic nanoparticles (iron (Fe), nickel (Ni), neodymium (Nd), combinations thereof), carbon nanotubes and fullerenes, polymers, oligomers, small molecules, among others. In some examples, a degree of densification (as measured by the volume reduction of the nanofiber sheet) is less for an infiltrated sheet than for a fully densified sheet (e.g., a sheet treated with an organic solvent that is later removed, as described below) because some of the free volume between the individual fibers is occupied by the material infiltrated into the sheet even after volatile components of the infiltrated material are removed.

The advantage of adding additional materials to the nanofiber strand 620 via a fluid applied at the densification station 616 is that the particles can be moved to an interior of the nanofiber strand 620, and therefore ultimately disposed within an interior of a nanofiber yarn fabricated from the nanofiber strand 620. Furthermore, a protective material can be introduced into the nanofiber strand 620 via the fluid of the densification station 616 along with the nanoparticle so that the nanoparticles are protected from environmental, physical, or chemical degradation. An example of a protective material that can be used to inhibit corrosion of some types of nanoparticles (e.g., Ag nanoparticles, Fe nanoparticles) is polydimethylsiloxane (PDMS). The PDMS can be dissolved by a solvent that also suspends the Ag nanowires, both of which are then provided to the nanofiber sheet 612/nanofiber strand 620 at the densification station 616. Thus, upon being drawn into the nanofiber strand 620 at the densification station 616, the Ag nanofibers are partially or entirely coated by PDMS, thus inhibiting corrosion (commonly referred to as "tarnishing"). This helps preserve the conductivity exhibited by nanofiber yarns 632 that include the Ag nanofibers. Advantages for an example nanofiber composite that incorporates Ag nanowires is described below in more detail in the "Experimental Results" section.

The optional drier 624 removes solvents or other volatile chemicals applied to the nanofiber sheet 612 at the densification station 616 and/or cures materials applied at the densification station 616. The optional drier 624 can remove chemicals and/or cure materials by applying heat, vacuum, changes in relative humidity, radiation (e.g., ultra-violet (UV), infra-red (IR)), and combinations thereof to the nanofiber strand 620.

The untwisted nanofiber strand 620 exiting either the densification station 616 or the solvent drier 624 enters the false twist yarn spinner 628. As described above, the false twist yarn spinner 628 twists nanofibers together at points between endpoints of a nanofiber strand 620/nanofiber yarn 632 (i.e., the nanofiber forest 604 and the bobbin 650).

While not shown, the nanofiber strand 620 can be physically guided through the system 600 at various locations by guides (e.g., hoops, hooks, or posts) that are not chemically or physically reactive with the nanofiber strand 620. The guides may also be configured to provide a tension to the nanofiber strand 620 (and/or the false twisted nanofiber yarn 632) that facilitates alignment of individual carbon nanotubes with each other and with a longitudinal axis of the nanofiber strand 620 and/or nanofiber yarn 632. The aligning effect can alter the mechanical or electrical properties of the yarn such as by increasing or decreasing the electrical conductivity and mechanical strength of the yarn produced.

Also not shown, but which may be included in the system 600, are a conductivity testing apparatus, and a yarn tension monitor.

Nanofiber Yarn Spinner

Figure 7:
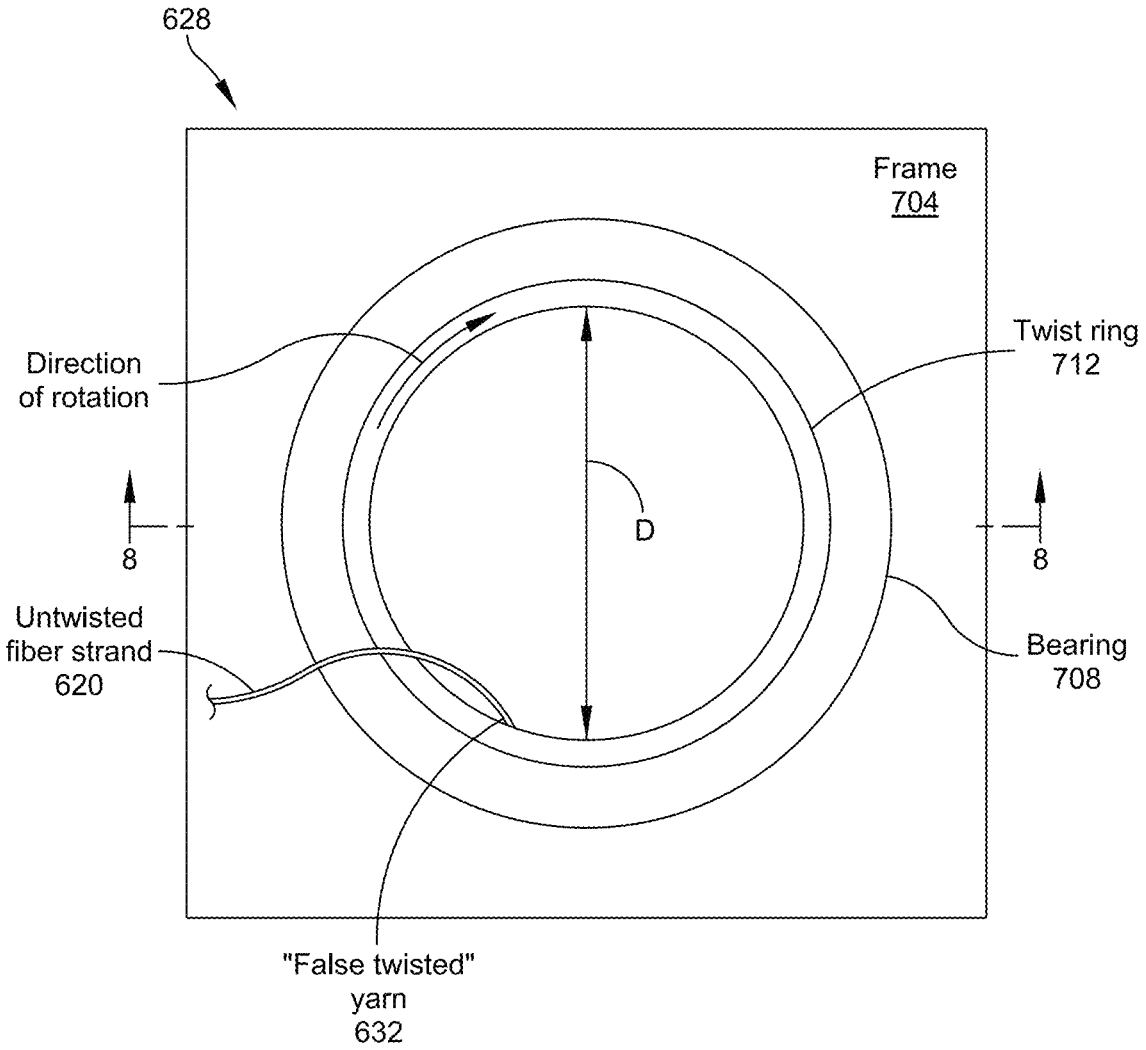
FIG. 7 is a schematic plan view of a false twist yarn spinner, in an embodiment.
Figure 8:
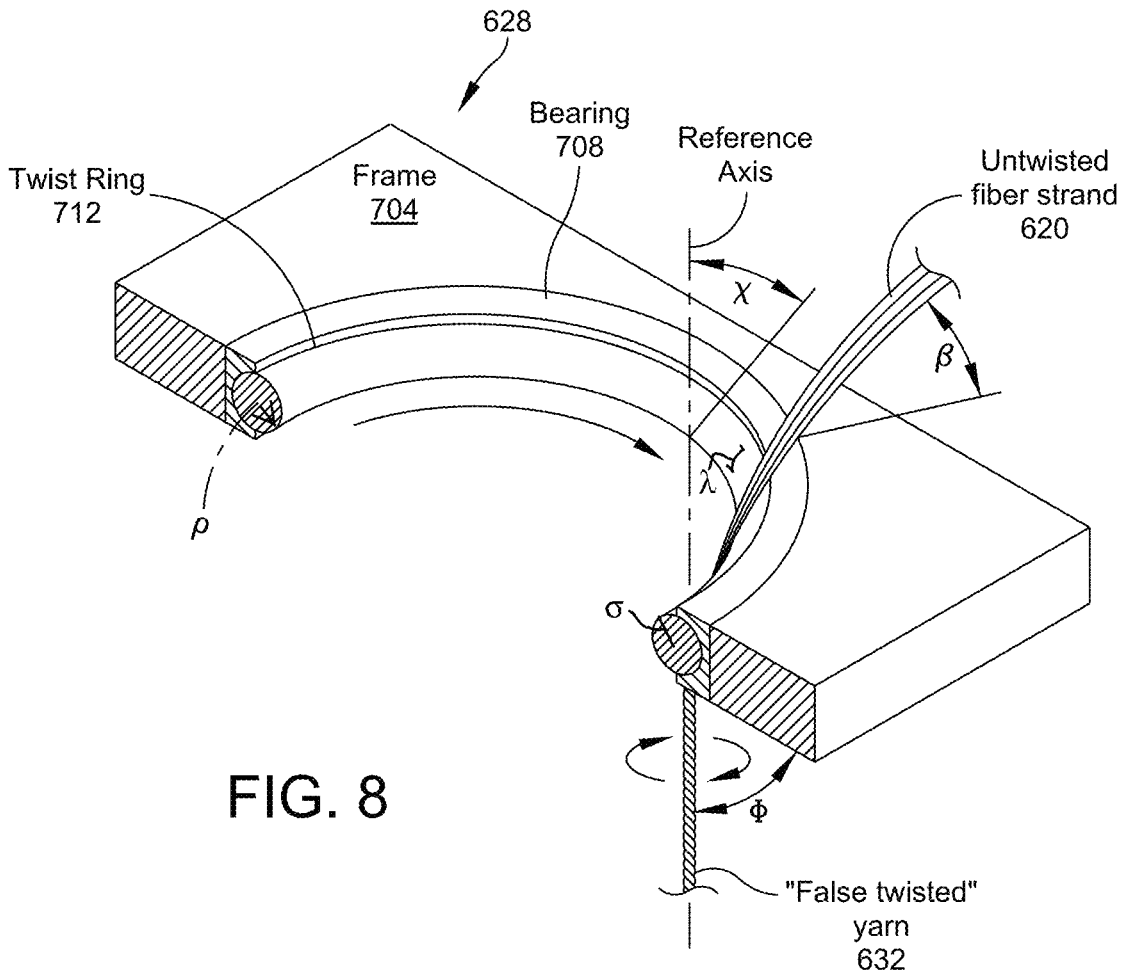
FIG. 8 is a schematic perspective cross-sectional view of a false twist yarn spinner, in an embodiment.

FIGS. 7 and 8 illustrate a plan view and a cross-sectional view of the nanofiber "false twist" yarn spinner 628 (or simply "yarn spinner 628" for convenience). The yarn spinner 628, and more specifically a "twist ring" 712 that is a component of the yarn spinner 628, provides a frictional force to an exterior surface of untwisted nanofiber strand 620. The twist ring 712 is at least partially transverse to a longitudinal axis of untwisted nanofiber strand 620, thus "false twisting" the untwisted nanofiber strand 620 into yarn 632.

As shown in both FIGS. 7 and 8, the yarn spinner 628 includes a frame 704, a bearing 708, and a twist ring 712. The frame 704 is any structure that can be used to assemble the bearing 708 and the twist ring 712 together and stabilize them for providing a false twist to a nanofiber strand 620, thus producing nanofiber yarn 632. The frame can be fabricated from any material (e.g., a metal, a plastic) to which a bearing 708 can be mounted to.

In some alternative embodiments of the yarn spinner 628, the bearing 708 and the twist ring 712 are configured to be on an exterior circumference of a frame, rather than on an interior circumference as is shown in FIGS. 7 and 8. For example, an alternative configuration of a false twist yarn spinner can include a rotating axle that is either fabricated from a material used for the twist ring 712 (described below) or has a twist ring disposed (in whole or in part) around the axle. The rotating axle can be oriented with respect to an untwisted nanofiber strand 620 so that a longitudinal axis of the rotating axle is at an angle less than 90° and greater than 0° with respect to the longitudinal axis of the untwisted nanofiber strand 620. In this way, the rotation of the rotating axle includes a component that is transverse to the longitudinal axis of the untwisted nanofiber strand 620, thus providing a false twist to locations between end points of the untwisted nanofiber strand 620. Similarly, a twist ring 712 can be arranged on an outer circumference of one or more wheels that provides a transverse twisting force to an untwisted nanofiber strand 620, thus fabricating a false twisted nanofiber yarn 632.

Returning to the example depicted in FIGS. 7 and 8, the bearing 708 is mounted to the frame 704 and is used to rotate the twist ring 712 (described below in more detail) so as to provide a false twist to a previously untwisted nanofiber strand 620, thereby producing a false twist nanofiber yarn 632. The bearing 708 is connected to a motor (not shown) that provides the force used to rotate the bearing 708 and the connected twist ring 712.

Referring to both FIG. 7 and FIG. 8, the example bearing 708 is a "circular" bearing, alternatively referred to as a "round" bearing or a "rolling element" bearing. Generally, these types of bearings work by placing ball bearings, cylinders or cones (or some other "rolling element") between an inner ring and an outer ring. The ball bearings reduce the friction between the inner ring and outer ring, allowing one or more of the rings to move with relative ease. Other configurations of rolling element bearings can be adapted to providing a rotating motion to the twist ring 712, including but not limited to rotating turntables, spherical roller bearings, and needle roller bearings. Other types of bearings may also be used, such as low friction PTFE bearings, fluid bearings and magnetic bearings, among others. The bearing 708 is rotated through direct or indirect forces supplied by a motor 714 or other source of rotational movement.

The motor may be linked to the ring by any linkage capable of transmitting the required motion such as gears, chain, direct drive, or friction drive. In the example shown, the twist ring 712 is mounted on an inner surface of the bearing 708, and thus rotates with the inner surface of the bearing. The twist ring 712 is, in the example shown, composed of silicone rubber. Silicone rubber is a convenient choice for the twist ring 712 because it can be configured with a surface that has a coefficient of friction (generally from 0.25 to 0.75, or more measured relative to the carbon nanofiber strand/yarn) high enough to grip the nanofiber and provide a twisting force to the untwisted nanofiber strand 620 while at the same time having a surface energy (approximately 24 milliNewtons/meter (mN/M)) that is low enough to reduce the rate of accumulation of contaminants. Silicone rubber is, generally chemically inert and therefore also will not contaminate the untwisted nanofiber strand 620 during false twisting. Silicone rubber is also generally chemically stable and will itself not degrade upon exposure to the nanofibers. In cases where contamination is a concern, the twisting process can be performed in a clean room.

The selection of an inner diameter D of the twist ring 712 can be based in part on the ratio of the diameter of the untwisted nanofiber strand 620 to the inner diameter D of the twist ring 712. In one example, the inner diameter D of the twist ring 712 is 100 mm. In other examples, the inner diameter D of the twist ring can be within any of the following ranges: 10 mm to 500 mm; 65 mm to 90 mm; 10 mm to 250 mm; 10 mm to 100 mm; 100 mm to 500 mm; 100 mm to 300 mm; 250 mm to 500 mm. In other examples, the ratio of inner diameter of the twist ring to the diameter of the nanofiber yarn being spun are in any of the following ranges: from 5:1 to 5000:1; from 5:1 to 4000:1; from 10:1 to 4500:1; from 1000:1 to 3500:1; from 2000:1 to 10,000:1. In one example, the ratio of inner diameter of 100 mm of the twist ring 712 to the 30 μm diameter of the nanofiber yarn is 3333:1

A radius of curvature p of the surface of twist ring 712 (shown in FIG. 8) can also be varied to alter a twist frequency and/or a twist force that is applied to the yarn. For example, radius p can vary from infinite (flat inner surface of the ring) to 5 mm or less. In specific embodiments, p can be less than 10 cm, less than 5 cm, less than 1 cm, less than 5 mm, greater than 1 mm, greater than 5 mm, greater than 1 cm, greater than 10 cm or greater than 1 m. Radius p can be constant around the circumference of the twist ring 712 or may vary.

Based on a nanofiber yarn fabrication rate of 30 meters/minute and an embodiment of a twist ring 712 that has a minor radius σ (indicated in FIG. 8) of 0.5 centimeter (cm), an untwisted strand/nanofiber yarn is in contact with the twist ring 712 for approximately 5 milliseconds (assuming contact with ¼ of the outer surface of a twist ring having a circular cross-section, the length of contact illustrated in FIG. 8 as λ). In another embodiment, at the same linear fabrication rate, a twist ring 712 having a minor radius σ of 1 millimeter (mm) will be in contact with the twist ring for 0.5 milliseconds (again assuming contact between the nanofiber strand/yarn and ¼ of the outer surface of a twist ring having a circular cross-section indicated as λ in FIG. 8). It will be appreciated that any one or more of (1) increasing yarn fabrication rates from a nanofiber forest, (2) decreasing a minor radius σ of a twist ring, and (3) adjusting the various angles so as to reduce the length of contact λ between a nanofiber strand/nanofiber yarn and a twist ring will reduce the contact time to, for example, as low as 0.005 milliseconds. The radius of curvature ρ and the minor radius σ are, in the example illustrated in FIG. 8, approximately the same, however this need not be the case.

Another variable that can be adjusted to alter the twist properties is an angle of entry at which the untwisted nanofibers approach and contact the twist ring 712. If the fibers pass over the radius of twist ring 712 in a vertical plane perpendicular relative to a plane in which the rotational axis of twist ring 712 is disposed (i.e., parallel to the reference axis indicated in FIG. 8), the angle of the nanofibers is said to be 0°. In such a case, fiber strand 620 will enter the space defined by twist ring 712 in an approximately straight line that is substantially parallel to the twist ring's axis of rotation and the reference axis. If the fibers enter the twist ring 712 from a direction that is essentially parallel to a plane defined by the twist ring and perpendicular to the axis of rotation and the reference axis, then β is said to be 90°. As shown in FIG. 8, β is about 45°. Among other parameters, this angle β can affect a length of contact λ (described below) between the nanofiber strand/yarn and the twist ring, which in turn affects a twist angle and/or extent of twist applied to the yarn.

Another variable that can affect twist is the lateral angle χ of the nanofibers as they cross over the surface of the ring. If the fibers are in contact with the twist ring 712 surface at an angle that is parallel to the axis around which twist ring 712 spins (and thus parallel to the reference axis shown in FIG. 8), and the fibers pass across the surface perpendicular to the direction of rotation, the angle χ of the nanofibers is deemed to be 90°. If the fibers enter the ring at an angle biased in a direction toward the direction of rotation of the twist ring 712, then angle χ is greater than 90° and would reach a maximum of 180° upon becoming parallel to a plane of rotation of the twist ring 712 (if possible given the physical constraints of the frame 704). If the fibers enter the ring at an angle biased against the direction of rotation of the ring then χ is less than 90° and would decrease to 0° when parallel (if possible given the physical constraints of the frame 704) to the direction of rotation of the twist ring 712. Thus, the lateral angle of the nanofibers or yarn in relation to the twist ring can be between 0° and 180°, although angles close to 0° or 180° may not be achieved. In various embodiments, lateral angle χ in relation to the ring can be greater than 90°, greater than 100°, greater than 110°, greater than 120°, less than 90°, less than 80°, less than 70° or less than 60°. In some embodiments, this angle may be from 30° to 150°, 45° to 135°, 60° to 120°, 45° to 90°, 90° to 135°, 90° to 120° or 100° to 120°. Lateral angle $\chi$ can be altered by rotating twist ring 712 to tilt to the left or right relative to the untwisted fiber strand 620. Note that when lateral angle $\chi$ is 90°, the force vector of the rotating ring is normal to the axis of the yarn. As this angle decreases or increases, the force vector shifts to applying a more diagonal force to the nanofibers and is not simply applying rotational force to the yarn around its axis. This too can affect a length of contact $\lambda$, described below in more detail.

It may also be important to control a length of contact between the nanofiber strand/yarn with the surface of the twist ring at any point in time. This length of contact $\lambda$ can be controlled by at least five variables including the angle of entry $\beta$, the radius of curvature $\rho$ of the surface of the twist ring 712, the minor radius $\sigma$ of the twist ring 712, the angle $\varphi$ at which the false twisted yarn leaves the plane of twist ring 712 and the lateral angle $\chi$, as described above. In general, greater contact length $\lambda$ is achieved with a larger radius ring surface $\rho$, a larger minor radius $\sigma$, a greater exit angle $\varphi$, a greater angle of entry $\beta$, and a greater lateral angle $\varphi$. In examples, values of $\beta$ can be within any of the following ranges: 10° to 70°; 10° to 35°; 10° to 15° to 25°; 35° to 70°; 35° to 45°; 45° to 70°; 55° to 70°. In examples, value of $\varphi$ can be within any of the following ranges: 70° to 110°; 70° to 90°; 70° to 80°; 90° to 110°; 100° to 110°. Any one or more of these variables may be adjusted to change the false twist properties of the resulting yarn. These angles may also be changed to account for other changes to the system such as number or size of nanofibers, diameter of the yarn, density of the yarn, tightness of the yarn, draw speed of the yarn, twist density of the yarn, or the rotational speed of twist ring 712. In some cases, the length of contact $\lambda$ of the strand/yarn with the surface of the ring may be more than $10^3$, $10^4$, $10^5$, $10^6$ or $10^7$ times that of the diameter of the individual nanofibers. In other cases, the length of contact $\lambda$ of the yarn with the surface of the ring may be more than 100, $10^3$, $10^4$, $10^5$, $10^6$ or $10^7$ times the width of the false twisted yarn. In other embodiments, the length of contact $\lambda$, speed of draw and speed of rotation can be chosen so that the yarn is subjected to a certain number of rotations (i.e., a number of complete 360° rotations of the yarn itself) before exiting the ring. For example, while in contact with the surface of ring 712, the yarn may be subjected to greater than $10^3$, $10^4$, $10^5$ or $10^6$ rotations from the time where it first contacts the ring to when it loses contact with the ring.

Alternative factors used to select an inner diameter D of the twist ring 712 can include a speed (or range of speeds) at which the twist ring 712 can be operated, the angle of twist in one revolution of the false twist nanofiber yarn 632, the number of twists per unit length of false twist nanofiber yarn 632, and the rate (in units of length/time) that the untwisted nanofiber strand 620 is fed through the yarn spinner 628. In some embodiments, multiple strands of untwisted nanofiber strands can be configured to contact separate portions of a same twist ring 712, thus increasing the productivity of a single false twist nanofiber yarn spinner 628.

While not shown, the nanofiber strand 620 and the false twisted nanofiber yarn 632 are guided by hooks, loops, or other guides so that the nanofiber strand 620 contacts a surface of the twist ring 712 in a way that facilitates imparting a false twist to the nanofiber strand 620. This is schematically shown in FIG. 8. It will also be appreciated that the untwisted nanofiber strand 620 is partially compacted from its contact with the twist ring 712, thus configuring the strand into an approximately cylindrical conformation. This may also have the effect of causing some nanoparticles introduced at the densification station and that are disposed on a surface of the untwisted nanofiber strand 620 to become entrained within an interior of the false twist nanofiber yarn 632. While only a single yarn spinner 628 is shown in FIGS. 7 and 8, it will be appreciated that this is only for convenience and that other embodiments of the system 600 may include multiple yarn spinners 628.

Optionally a nanofiber yarn 632 may be passed through multiple yarn spinners 628 in series to more finely control the exterior dimensions of the yarn or spin multiple individual threads of yarn together. Additional yarn spinners can spin in the same direction or an opposite direction to the first yarn spinner.

After passing through the yarn spinner 628, the false twist nanofiber yarn 632 is wound onto a bobbin 650. The bobbin 650 may also provide a tensile or pulling force on the false twist nanofiber yarn 632 and the untwisted nanofiber strand 620 throughout the entire nanofiber yarn fabrication system 600 so that nanofibers from the nanofiber forest 604 continue to be removed from the substrate 608 and progressively processed by the fabrication system 600 into false twisted nanofiber yarn 632. The tensile force can be constant or be varied by varying a torque applied to the bobbin 650 by a motor, spring, or other mechanism. The magnitude of the tensile force can also be used to influence an alignment between nanofibers of the yarn, an alignment of nanoparticles with the nanofibers (e.g., at least some longitudinal axes of nanofibers and of nanoparticles are aligned), and an alignment of nanoparticles with each other. Generally speaking, the greater the magnitude of the tensile force the higher a degree of alignment between nanofibers, between nanofibers and nanoparticles, and between nanoparticles.

In another embodiment, the false twist yarn spinner 628 may also include features described above in the context of the optional drier 624. For example, elements that expose the false twist nanofiber yarn 632 to heat, vacuum, and/or radiation may be incorporated with the spinner 628. These elements can be used to remove volatile chemicals and/or cure materials previously applied to the nanofiber sheet 612.

In another embodiment, the nanofiber yarn fabrication system 600 includes a device to measure and/or monitor yarn diameter in situ as the nanofiber yarn is being spun. One example device to measure yarn diameter is a laser micrometer. Other optical systems to measure diameter and/or width may also be used. In another embodiment, the nanofiber yarn fabrication system 600 can include a device for measuring conductivity in situ of the nanofiber yarn as it is produced, such as a conductivity meter or other electrical probe. Using devices to measure the physical dimensions and electrical properties of nanofiber yarn in situ produces information that can be used to alter processing conditions so that desired properties of the nanofiber yarn are either maintained or achieved.

One application of nanofiber yarn fabrication system 600 includes using the system to twist two different compositions of nanofiber yarn together. For example, a nanofiber yarn that is hydrophobic can be twisted with a nanofiber yarn that is hydrophilic. This composite nanofiber yarn can then be applied to a substrate that is also either hydrophilic or hydrophobic using a compatible adhesive because at least one of the hydrophilic or hydrophobic will be adherable to the substrate.

Experimental Example

In an experimental example, a nanofiber forest was grown on a stainless steel substrate 2.06 cm wide using an iron catalyst. The nanofiber sheet was drawn from the substrate using techniques described in PCT Publication No. WO 2007/015710. The nanofiber sheet was drawn to a diameter of approximately 50 μm in diameter at an angle α of approximately 2° to 20° and passed through a bath of toluene in which were suspended Ag nanowires and Sylguard® PDMS polymer (available from Dow Corning Inc.). The Ag nanowires, suspended in isopropyl alcohol had a diameter of approximately 50 nm to approximately 70 nm and a length of approximately 20 μm to approximately 40 μm.

The false twist yarn spinner 628 produced a false twist nanofiber yarn having a diameter of 30 μm and a twist angle of between 5° and 30°. The false twist yarn produced had an ultimate tensile stress of between 0.8 GPa and 1.2 GPa and a conductivity of between approximately 4000 Siemens and 6000 Siemens. The sample also exhibited a fatigue limit of 10 million cycles. This is contrast to a control sample produced using the same process described in this Experimental Example section except that no Ag nanowires were provided to the false twist nanofiber yarn control sample. In this control sample, the ultimate tensile stress was between 1.0 GPa and 1.5 GPa and had a conductivity of between approximately 600 Siemens and 650 Siemens.

Yarn Spinner Alternative Embodiments

Figure 9:
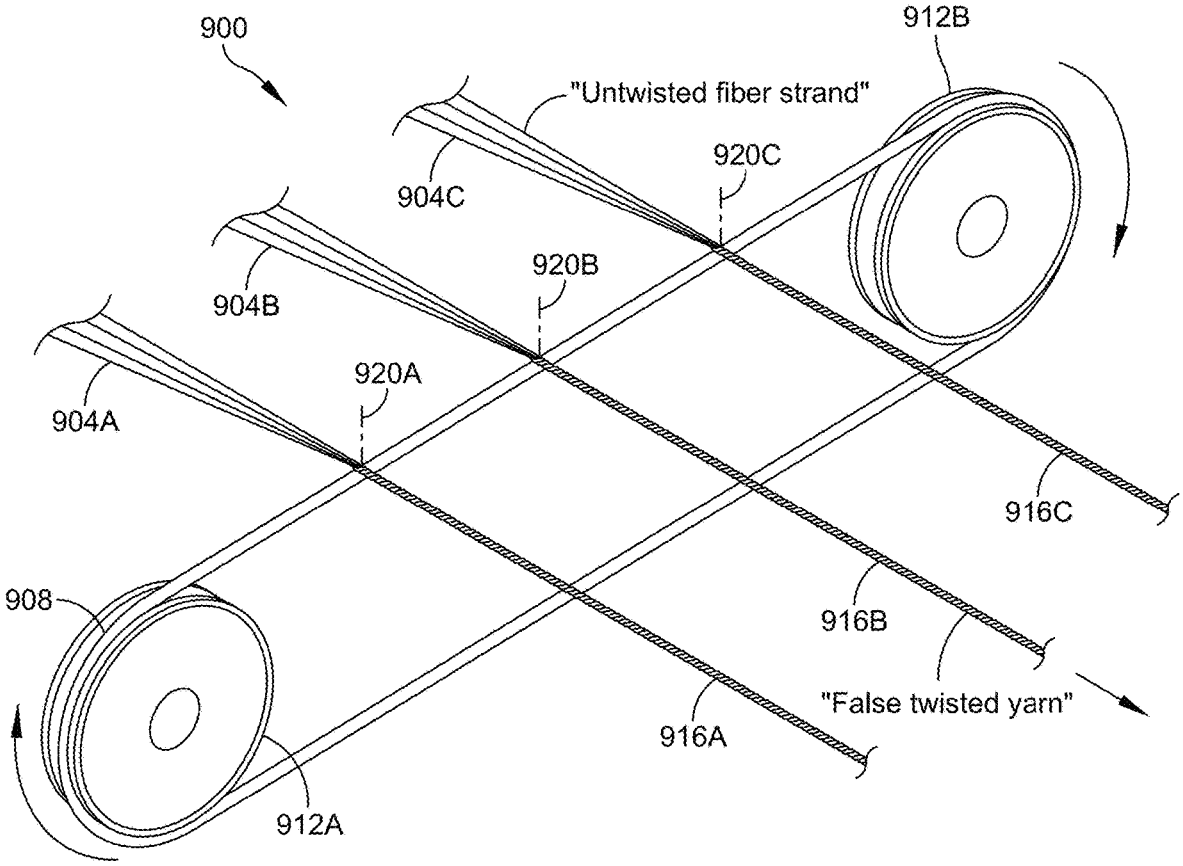
FIG. 9 is a schematic perspective view of a false twist yarn spinner, in an embodiment.

FIG. 9 illustrates an alternative embodiment 900 of the yarn spinner 628. The yarn spinner 900 includes a twist belt 908, and two wheels 912A, 912B.

The two wheels 912A and 912B are rotated by one or more motors or other mechanisms (not shown) in a same direction. The two wheels 912A, 912B can be any diameter and fabricated from any material and/or design that is able to maintain contact with, and cause motion of, the twist belt 908.

The twist belt 908 is placed in contact with the two wheels 912A and 912B so that the twist belt 908 rotates in response to the rotation of the two wheels 912A and 912B. The twist belt 908 can be made from any of the materials previously described above in the context of the twist ring 712. Similarly, the diameter of the twist belt 908, the angle of entry β, the lateral angle χ, rotation speed, and contact length λ can be any of the values previously described above for the twist ring 712.

Similar to the embodiments described above, one or more untwisted nanofiber strands 904A, 904B, 904C (whether densified or undensified) are placed into contact with the twist belt 908. Upon movement of the twist belt 908 (indicated by arrows in FIG. 9), the untwisted nanofiber strands 904A-904C are "false twisted" into false twist nanofiber yarns 916A-916C. These can then be wound onto a bobbin 650, as described above. One advantage of the embodiment 900 is that the linear regions of the twist belt 908 between the wheels 912A, 912B can simultaneously accommodate the false twisting of a plurality of nanofiber strands. In some embodiments, a plurality of posts 920A-920C can be placed proximate to both the twist belt 908 and the untwisted nanofiber strands 904A-904C. These posts maintain alignment of the untwisted nanofiber strands 904A-904C despite movement of the twist belt 908 that can have a component perpendicular to the direction in which the nanofiber strands 904A-904C are drawn (indicated by the arrow in FIG. 9) and which could otherwise cause the untwisted nanofiber strands 904A-904C to drift into one another in the direction of travel of the twist belt 908.

Method

Figure 10:
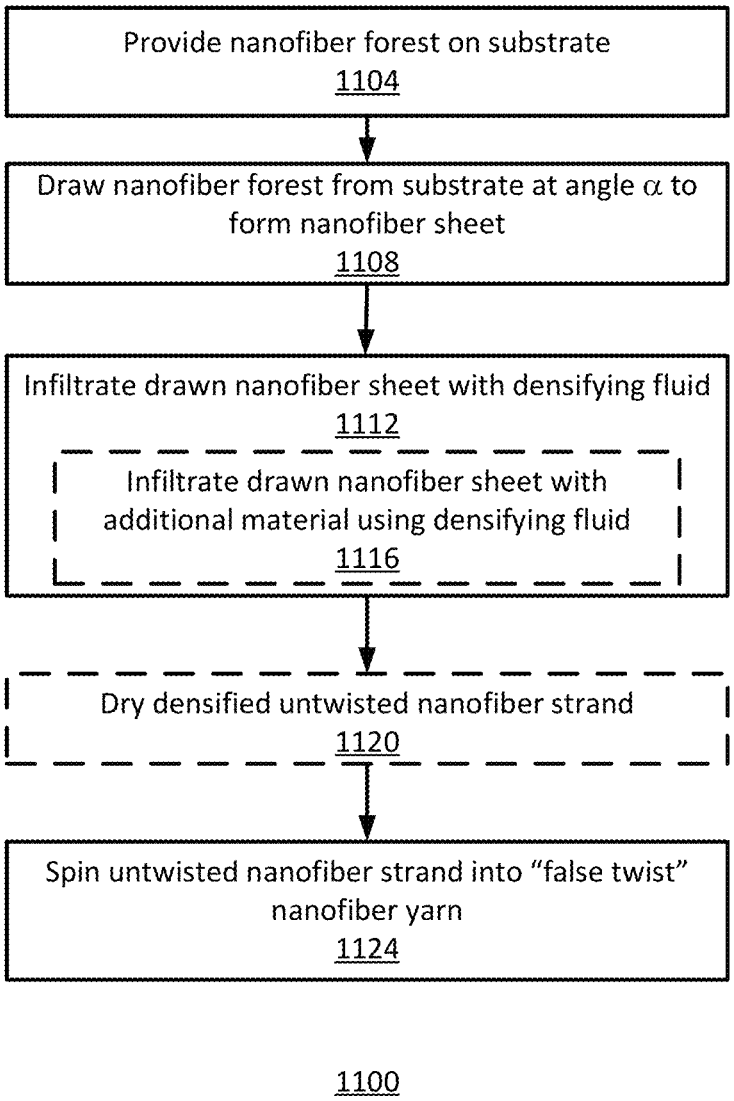
FIG. 10 is a method flow diagram for fabricating a false twist nanofiber yarn, in an embodiment.

FIG. 10 illustrates a method 1100 for fabricating a false twist nanofiber yarn from a nanofiber forest. The method 1100 begins by providing 1104 a nanofiber forest on a substrate. The nanofiber forest is drawn 1108 as a nanofiber sheet from the substrate at an angle α, which causes a width β of the nanofiber sheet to narrow to a width β', as described above. The nanofiber sheet having a width β is then infiltrated 1112 with a densifying fluid and optionally infiltrated 1116 with at least one additional material that is dissolved, suspended, or both in the densifying fluid. After densification, the dimensions of the nanofiber sheet are such that it is referred to as an untwisted nanofiber strand. The untwisted nanofiber strand is optionally dried 1120. The untwisted nanofiber strand then enters a false twist yarn spinner and is spun 1124 into a false twist nanofiber yarn.

Further Considerations

The foregoing description of the embodiments of the disclosure has been presented for the purpose of illustration; it is not intended to be exhaustive or to limit the claims to the precise forms disclosed. Persons skilled in the relevant art can appreciate that many modifications and variations are possible in light of the above disclosure.

The language used in the specification has been principally selected for readability and instructional purposes, and it may not have been selected to delineate or circumscribe the inventive subject matter. It is therefore intended that the scope of the disclosure be limited not by this detailed description, but rather by any claims that issue on an application based hereon. Accordingly, the disclosure of the embodiments is intended to be illustrative, but not limiting, of the scope of the invention, which is set forth in the following claims.

What is claimed is:

1. A method for spinning nanofiber yarn comprising:

providing a nanofiber forest on a substrate;

drawing the nanofiber forest from the substrate at an angle α to form a nanofiber sheet;

infiltrating the nanofiber sheet with a fluid to form an untwisted nanofiber strand having an exterior surface and a longitudinal axis;

passing the nanofiber strand through a twist ring, the twist ring having an inner diameter, a minor radius, an inner surface and an outer surface;

applying a force between the inner surface of the twist ring and the untwisted nanofiber strand between endpoints of the untwisted nanofiber strand, the force applied by the twist ring, the nanofiber strand having an angle of entry β from 10° to 70°, thus forming a false twist nanofiber yarn having a twist angle from 5° to 30° and an exit angle; and winding the false twist nanofiber yarn.

2. The method of claim 1, wherein applying the force comprises contact between the untwisted nanofiber strand and a surface of the twist ring while the twist ring is rotating.

3. The method of claim 2, wherein the contact between the untwisted nanofiber strand and the surface of the rotating twist ring is less than 5 milliseconds.

4. The method of claim 2, wherein the contact between the untwisted nanofiber strand and the surface of the rotating twist ring is less than 0.5 milliseconds.

5. The method of claim 2, wherein applying the force comprises using a silicone rubber surface as the surface of the rotating twist ring.

6. The method of claim 2, wherein applying the force comprises using a surface with a coefficient of friction from 0.25 to 0.75 between the surface of the rotating twist ring and at least one of the untwisted nanofiber strands and the nanofiber yarn.

7. The method of claim 2, wherein applying the force comprises using a surface with a surface energy of less than 30 milliNewtons/meter.

8. The method of claim 1, wherein infiltrating the nanofiber sheet further comprises infiltrating the nanofiber sheet with at least one of a polymer and a nanoparticle.

9. The method of claim 1, further comprising drying the untwisted nanofiber strand to remove the fluid.

10. The method of claim 1, wherein the angle $\alpha$ is in a range from 2° to 20°.

* * * * *